US011453113B1

(12) United States Patent
Hsieh

(10) Patent No.: US 11,453,113 B1
(45) Date of Patent: Sep. 27, 2022

(54) THREE AXIS LIMITING TOOL PLACEMENT DEVICE

(71) Applicant: Chih-Chien Hsieh, Taichung (TW)

(72) Inventor: Chih-Chien Hsieh, Taichung (TW)

( * ) Notice: Subject to any disclaimer, the term of this patent is extended or adjusted under 35 U.S.C. 154(b) by 0 days.

(21) Appl. No.: 17/319,807

(22) Filed: May 13, 2021

(51) Int. Cl.
*B25H 3/06* (2006.01)
*B25B 13/06* (2006.01)

(52) U.S. Cl.
CPC ..... *B25H 3/06* (2013.01); *B25B 13/06* (2013.01)

(58) Field of Classification Search
CPC ..... B25B 13/06; B25H 3/06; B25H 3/003; B25H 3/04; B25H 3/021; B25H 3/022; B25H 3/028; B65D 85/20
USPC ..... 211/70.6, 69, 85.13; 206/378, 372, 477, 206/560, 565, 493, 443
See application file for complete search history.

(56) References Cited

U.S. PATENT DOCUMENTS 4,958,732 A * 9/1990 Rau ..... B25H 3/003 206/443
5,284,245 A * 2/1994 Slivon ..... B25H 3/003 206/378
5,573,116 A * 11/1996 Zink ..... B25H 3/06 206/557
5,715,951 A * 2/1998 Dembicks ..... B25B 13/56 206/378
5,975,297 A * 11/1999 Kao ..... B25B 13/56 206/378
6,079,559 A * 6/2000 Lee ..... A47F 5/0006 206/443
6,119,859 A * 9/2000 Wen ..... B25H 3/003 206/372
6,126,004 A * 10/2000 Ling ..... B25H 3/04 206/378
6,145,662 A * 11/2000 Newton ..... B25H 3/06 206/483
6,367,628 B2 * 4/2002 Hu ..... B25H 3/003 206/372
6,431,373 B1 * 8/2002 Blick ..... B25H 3/003 206/378
6,488,151 B2 * 12/2002 Ramsey ..... B25H 3/06 206/378
6,508,360 B1 * 1/2003 Chen ..... B25H 3/003 206/349
7,100,777 B1 * 9/2006 Kao ..... B25H 3/04 206/464

(Continued)

*Primary Examiner* — Jennifer E. Novosad
(74) *Attorney, Agent, or Firm* — Egbert, McDaniel & Swartz, PLLC

(57) ABSTRACT

A three-axis limiting tool placement device includes a basic face having a placement area, and a tool placement track assembled in the placement area, wherein there is a three-axis limiting tool placement device in the placement area. The tool placement device includes a limiting part and an elastic hook fastener. The limiting part includes an abutment wall, two lateral limiting walls and a pressing edge to form axially limiting function of X, Y and Z axes of the first end of tool placement track. The elastic hook fastener includes an elastic arm and a hook-shaped portion formed with a dial control portion and a pressing surface. The pressing surface is pressed against the second end of the tool placement track to form a Z-axis limiting function. In addition, there is a corresponding relationship between the elastic arm and the second end of the tool placement track along the X axis.

10 Claims, 9 Drawing Sheets

(56) References Cited

U.S. PATENT DOCUMENTS 7,188,726 B2 * 3/2007 Lin ..... B25H 3/003 206/743
7,322,470 B2 * 1/2008 Brunson ..... B25H 3/021 206/378
7,513,364 B2 * 4/2009 Tsai ..... E05B 65/5276 206/372
7,806,264 B1 * 10/2010 Lai ..... B25H 3/003 206/375
8,069,984 B2 * 12/2011 Larson ..... B25H 3/023 206/372
8,286,807 B2 * 10/2012 Winnard ..... B25H 3/003 211/70.6
8,813,957 B1 * 8/2014 Kao ..... B25H 3/003 206/378
9,156,156 B2 * 10/2015 Wang ..... B25H 3/021
9,364,949 B2 * 6/2016 Ernst ..... B25H 3/06
9,403,270 B2 * 8/2016 Lin ..... B65D 25/106
9,522,467 B1 * 12/2016 Kao ..... B25H 3/06
9,527,206 B1 * 12/2016 Hsieh ..... B25H 3/04
10,105,835 B1 * 10/2018 Kao ..... A47F 5/0853
10,449,665 B2 * 10/2019 Ernst ..... B25H 3/003
2003/0019775 A1 * 1/2003 Ernst ..... B25H 3/003 206/378
2003/0080010 A1 * 5/2003 Ho ..... B25H 3/003 206/373
2003/0213760 A1 * 11/2003 Lee ..... B25H 3/003 206/378
2003/0222036 A1 * 12/2003 Lacombe ..... B25H 3/003 211/70.6
2003/0234196 A1 * 12/2003 Hu ..... B25H 3/04 206/372
2004/0069668 A1 * 4/2004 Finnigan ..... B25H 3/003 206/378
2004/0154942 A1 * 8/2004 Streich ..... E05B 65/5238 206/349
2004/0188366 A1 * 9/2004 Tong ..... B25H 3/003 206/378
2005/0241974 A1 * 11/2005 Chen ..... B25H 3/003 206/349
2006/0016706 A1 * 1/2006 Chen ..... B25H 3/003 206/379
2006/0070902 A1 * 4/2006 Tuan-Mu ..... B25H 3/003 206/378
2007/0023369 A1 * 2/2007 Lin ..... B25H 3/003 248/291.1
2009/0266730 A1 * 10/2009 Lin ..... B25H 3/003 206/372
2013/0126449 A1 * 5/2013 Sh ..... B25H 3/04 211/70.6
2016/0052125 A1 * 2/2016 Steele ..... B65D 25/205 206/349
2017/0361454 A1 * 12/2017 Hsu ..... B25H 3/003
2019/0061139 A1 * 2/2019 Kao ..... B65D 25/101
2021/0078159 A1 * 3/2021 Jiang ..... B65D 21/0213
2021/0394354 A1 * 12/2021 Miley ..... B25H 3/04

* cited by examiner

THREE AXIS LIMITING TOOL PLACEMENT DEVICE

CROSS-REFERENCE TO RELATED U.S. APPLICATIONS

Not applicable.

BACKGROUND OF THE INVENTION

1. Field of the Invention

The present invention relates generally to a tool placement device; and more particularly to a structure type of an innovative three-axis limiting type tool placement device.

2. Description of Related Art Including Information Disclosed Under 37 CFR 1.97 and 37 CFR 1.98

The tool placement device of the present invention is an improvement on U.S. Pat. No. 9,364,949B2, entitled "Slide Rail and Tray for Box Spanner". In the previous patent, the detachable state of the slide rails 14 in relation to the tray 12 is the mechanism design of button 56, when the button 56 is pressed by the user, the locking edge 52 of flexible arm will drop down to the underside of the bottom surface of slide rail, so that the slide rail 14 can slide on the top of the flexible arm in release condition. A slot 70 formed between the periphery of the button 56 and the bottom of the tray 12 allows the button 56 to be flexibly pressed and swung.

However, considering the operational safety, this kind of tool placement device product is required of a drop test before delivery, so as to check the firmness of the combination of the slide rail 14 and tray 12. At this point, as the button 56 can swing flexibly, at the moment when the whole tool placement device product drops down from high and impacts the ground, the button 56 is much more likely to vibrate and shift under the impact force, so that the slide rail 14 is released spontaneously and loosened, which is to say, the firmness of the combination of the slide rail 14 and tray 12 of said tool placement device is insufficient, they are likely to be separated from each other in operation, leading to safety problems.

BRIEF SUMMARY OF THE INVENTION

The fundamental purpose of the present invention is to provide a three-axis limiting tool placement device, based on said purpose, the technical characteristic of problem solving of the present invention is that the tool placement device includes a basic face. The basic face defines an X axis and a Y axis in the horizontal extension direction of the dissimilar plane, and the basic face defines at least one placement area.

At least one tool placement track is removably assembled in the placement area. The at least one tool placement track is elongated along the X axis, so as to form a first end, a second end and a long plate section between the first end and the second end. The long plate section is provided with a plurality of tool sockets. A cylinder protrudes from the tool sockets, and a Z axis is defined according to the protruding direction of the cylinder.

A three-axis limiting structure is formed in the placement area of the basic face, the three-axis limiting structure includes an end-type limiting part, formed at one end of X axis of the placement area and in the position corresponding to the first end of the corresponding tool placement track.

The end-type limiting part includes an end-type abutment wall, two lateral limiting walls and at least one pressing edge. The end-type abutment wall abuts on the end face of the first end of the corresponding tool placement track, so as to form the X-axis limiting function. The two lateral limiting walls abut on two sides of the first end of the corresponding tool placement track, so as to form the Y-axis limiting function. The at least one pressing edge is pressed against the top surface of the first end of the corresponding tool placement track, so as to form the Z-axis limiting function. The three-axis limiting structure also includes an elastic hook fastener, formed at one end of X axis of the placement area and in the position corresponding to the second end of the tool placement track. The elastic hook fastener includes an elastic arm protruding towards the Z axis from the placement area, and a hook-shaped portion formed at the protruding end of the elastic arm. The hook-shaped portion is formed with a dial control portion and a pressing face. The pressing face is pressed against the second end of the tool placement track, so as to form the Z-axis limiting function. The elastic arm corresponds to the second end of the tool placement track along the X axis.

In terms of the main effect and advantage of the present invention, a firm combination positioning state on X, Y and Z axes can be achieved between the tool placement track and basic face placement area, so as to effectively prevent the tool placement track from being loosened and displaced, there is practical progressiveness.

DETAILED DESCRIPTION OF THE INVENTION

Figure 1:
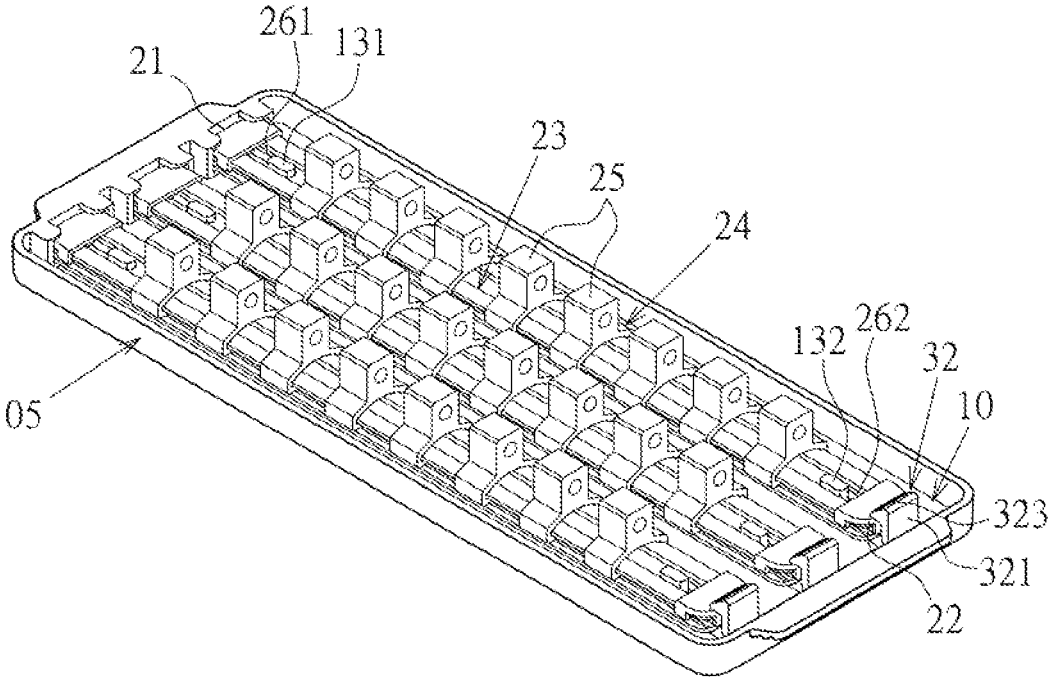
FIG. 1 is a combined stereogram of the preferred embodiment of the tool placement device of the present invention.
Figure 2:
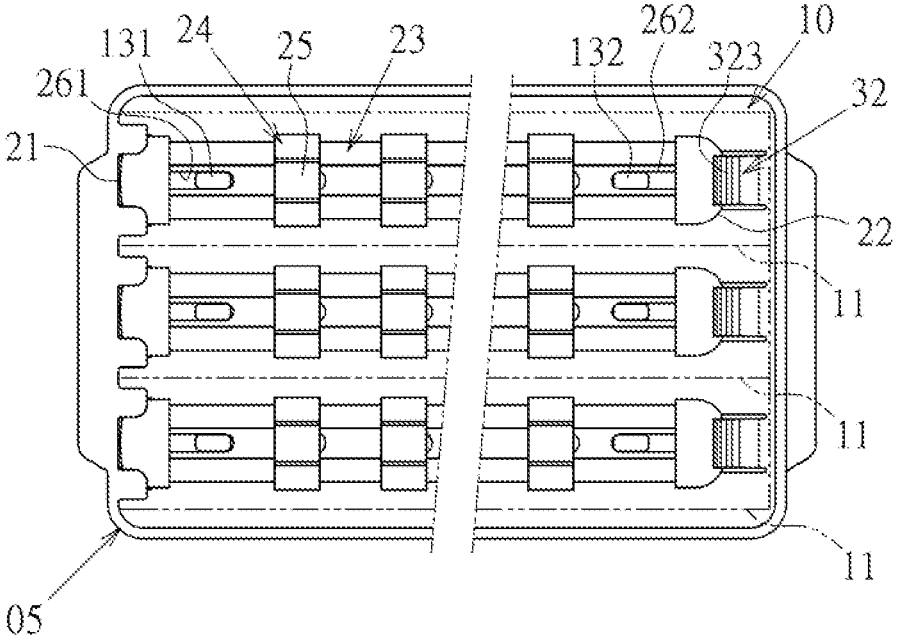
FIG. 2 is a top view of the preferred embodiment of the tool placement device of the present invention.
Figure 3:
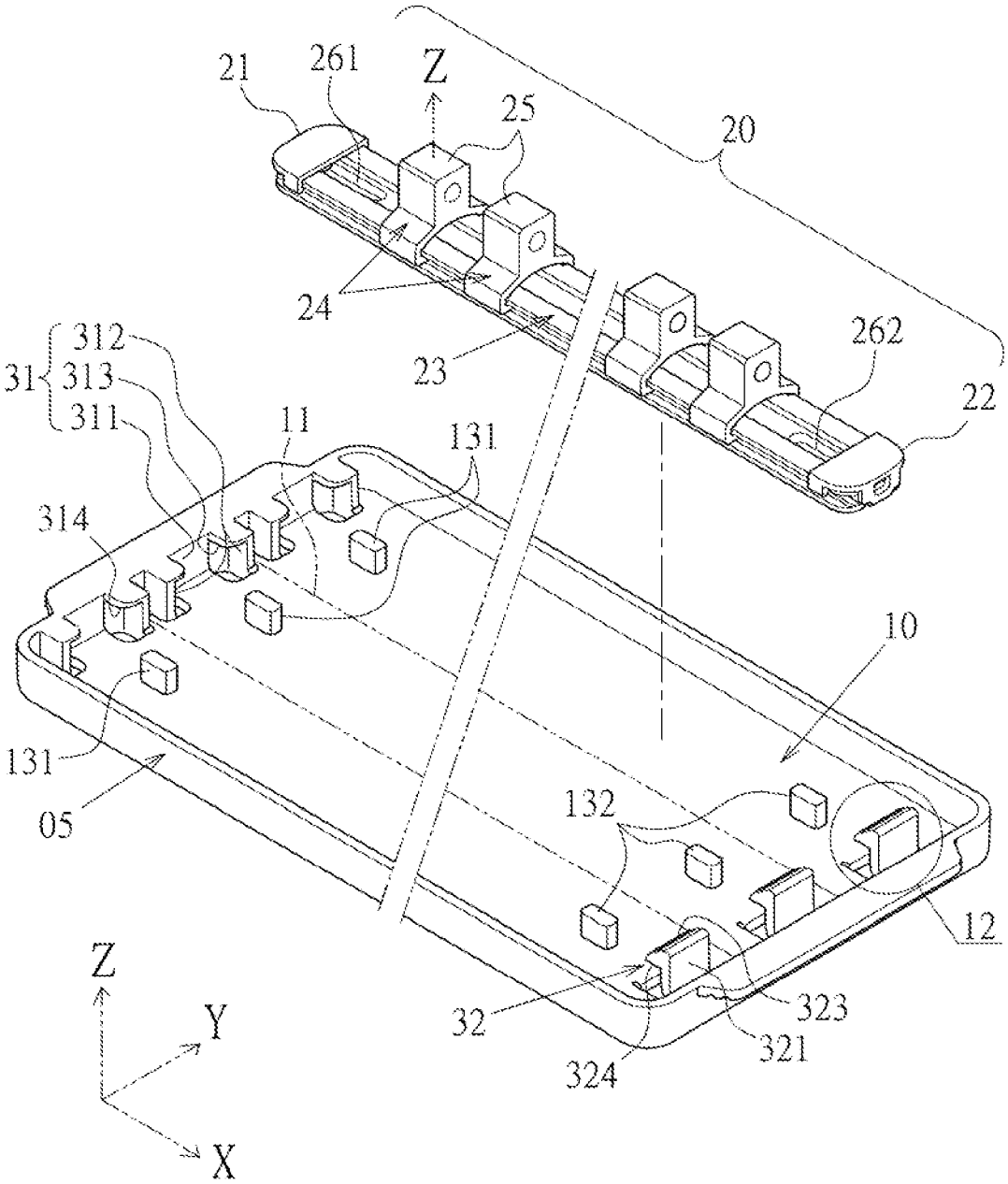
FIG. 3 is an exploded view of partial components in the preferred embodiment of the tool placement device of the present invention.

FIG. 1 to FIG. 3 show the preferred embodiments of the tool placement device of the present invention, but the embodiments are for illustration only, the patent application is not limited to this structure.

The tool placement device includes a basic face 10. The basic face 10 defines an X axis and a Y axis in the horizontal extension direction of the dissimilar plane, and the basic face 10 defines at least one placement area 11. At least one tool placement track 20 is removably assembled in the placement area 11. The at least one tool placement track 20 is elongated along the X axis, so as to form a first end 21, a second end 22 and a long plate section 23 between the first end 21 and the second end 22. The long plate section 23 is provided with a plurality of tool sockets 24. A cylinder 25 protrudes from the tool sockets 24, and a Z axis is defined according to the protrusion direction of the cylinder 25. A three-axis limiting structure is formed in the placement area 11 of the basic face 10. The three-axis limiting structure includes an end-type limiting part 31, formed at one end of X axis of the placement area 11 and in the position corresponding to the first end 21 of the corresponding tool placement track 20. The end-type limiting part 31 includes an end-type abutment wall 311, two lateral limiting walls 312 and at least one pressing edge 313. The end-type abutment wall 311 abuts on the end face of the first end 21 of the corresponding tool placement track 20, so as to form the X-axis limiting function. The two lateral limiting walls 312 abut on two sides of the first end 21 of the corresponding tool placement track 20, so as to form the Y-axis limiting function. The at least one pressing edge 313 is pressed against the top surface of the first end 21 of the corresponding tool placement track 20, so as to form the Z-axis limiting function. An elastic hook fastener 32 is formed at one end of X axis of the placement area 11 and in the position corresponding to the second end 22 of the tool placement track 20. The elastic hook fastener 32 includes an elastic arm 321 protruding towards the Z axis from the placement area 11, and a hook-shaped portion 322 formed at the protruding end of the elastic arm 321. The hook-shaped portion 322 is formed with a dial control portion 323 and a pressing face 324. The pressing face 324 is pressed against the second end 22 of the tool placement track 20, so as to form the Z-axis limiting function. The elastic arm 321 corresponds to the second end 22 of the tool placement track 20 along the X axis.

As shown in FIG. 1 to FIG. 3, in this case, the basic face 10 is formed on a tray 05 structure. This tray 05 is an individual member, and the user can place it on an appropriate plane according to application requirement.

Figure 13:
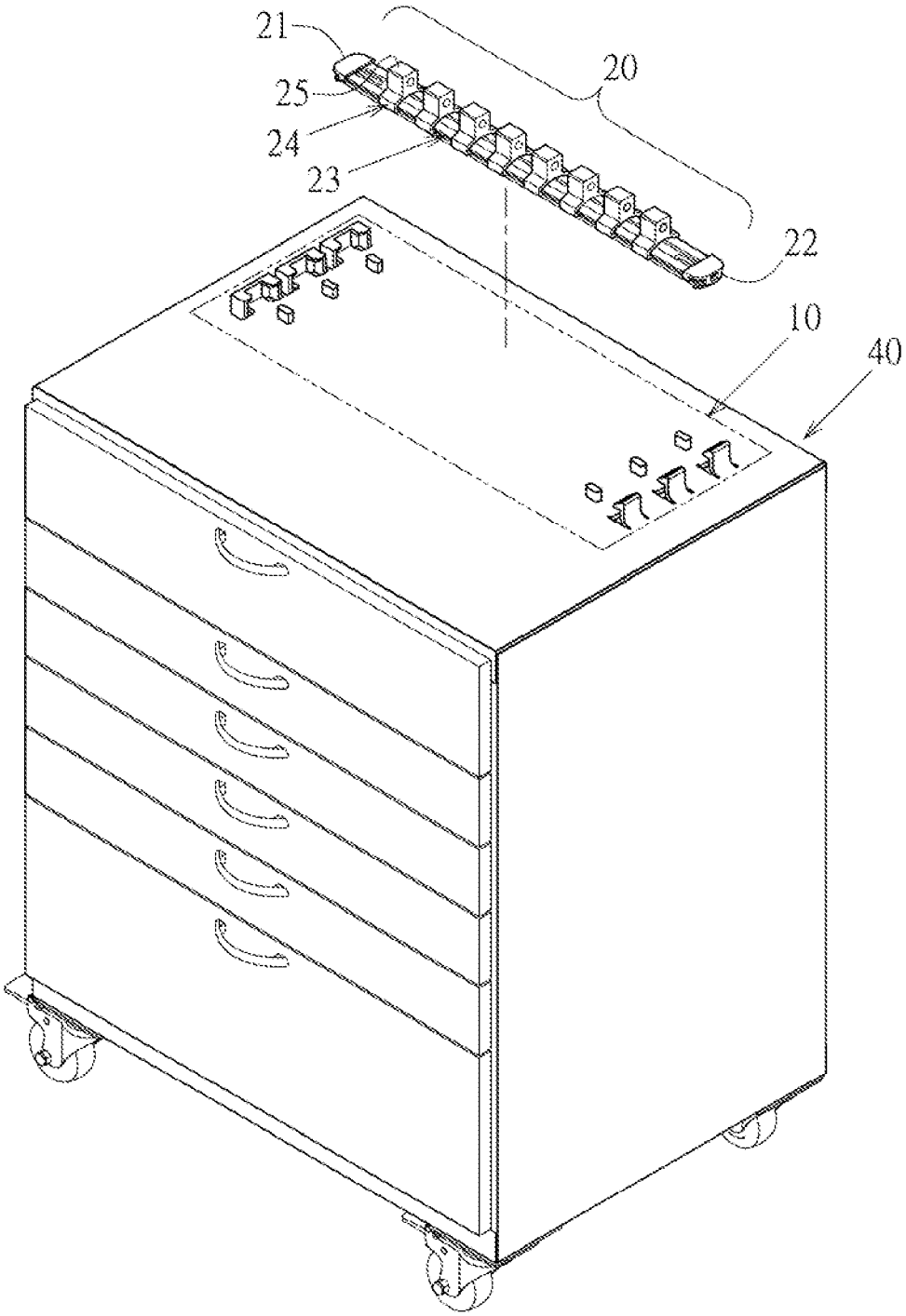
FIG. 13 shows the embodiment of the basic face of the present invention formed on local surface of a tool storage.

As shown in FIG. 13, in this case, the basic face 10 is formed on partial surface of a tool storage 40, said tool storage 40 is a toolbox, a tool rack or a tool chest.

Figure 4:
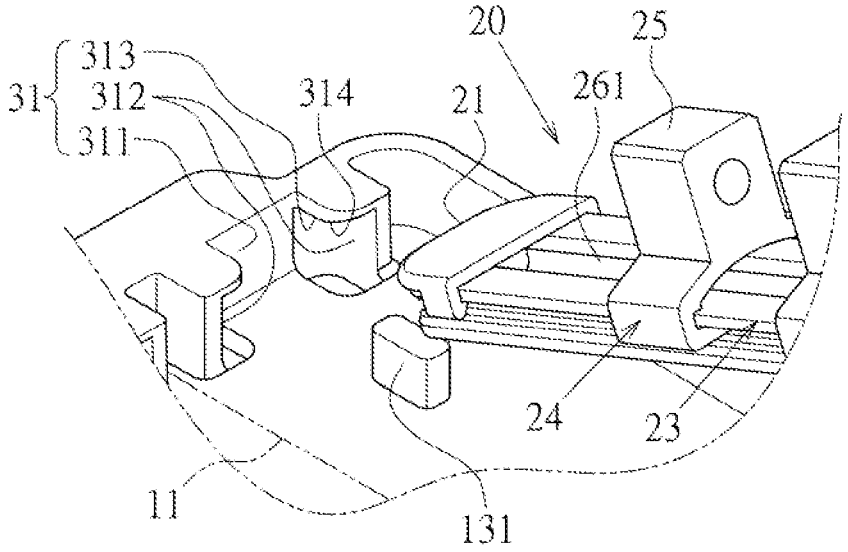
FIG. 4 is a stereogram I in combination action of the tool placement track of the present invention.
Figure 5:
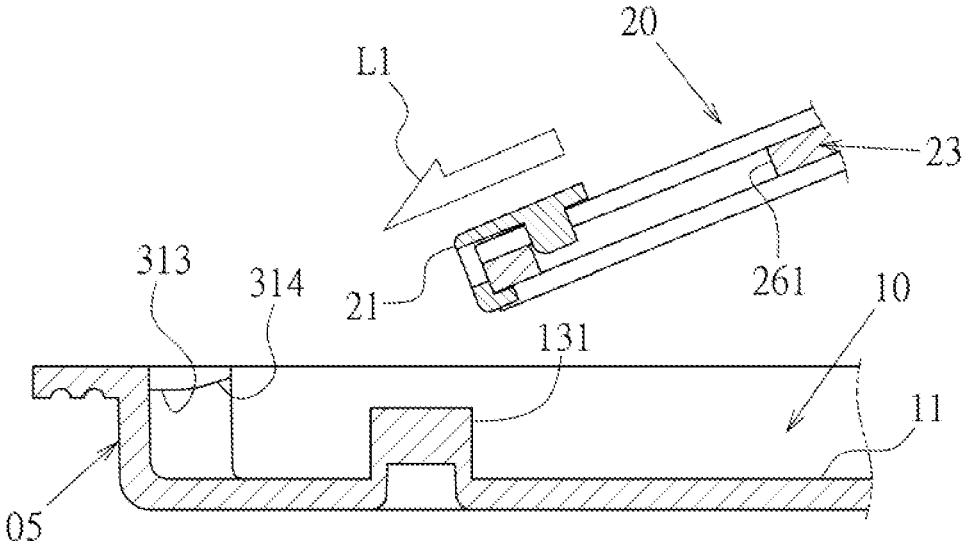
FIG. 5 is a longitudinal section view corresponding to FIG. 4.

As shown in FIG. 3 to FIG. 5, in this case, the at least one pressing edge 313 of the end-type limiting part 31 is formed with an oblique guide face 314. In terms of the effect of the configuration disclosed in this embodiment, the oblique guide face 314 is arranged to conform with the state when the first end 21 of the tool placement track 20 is inserted at an oblique angle, to enhance the smoothness of assembly of tool placement track 20.

The varied embodiment of the present invention can include at least one nesting part (figure number marked in next paragraph) formed on the long plate section 23 of the at least one tool placement track 20 and depressed or penetrated along the Z axis. The three-axis limiting structure is formed with at least one convex pin (figure number marked in next paragraph), protruding from the basic face 10 along the Z axis, and the location of the at least one convex pin (figure number marked in next paragraph) is exactly opposite to the at least one nesting part (figure number marked in next paragraph), so that they coordinate with each other, and the long plate section 23 achieves the limiting state of at least one axis of X and Y axes against the placement area 11.

Figure 11:
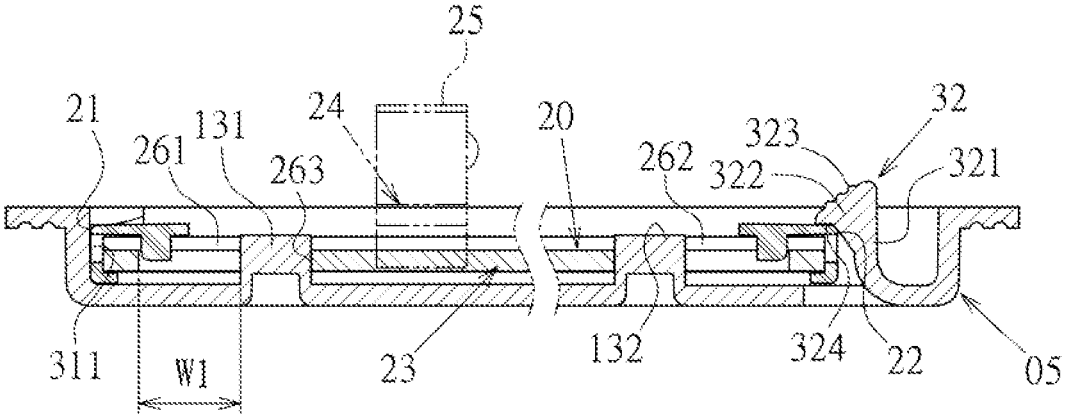
FIG. 11 is a longitudinal section view corresponding to FIG. 10.
Figure 12:
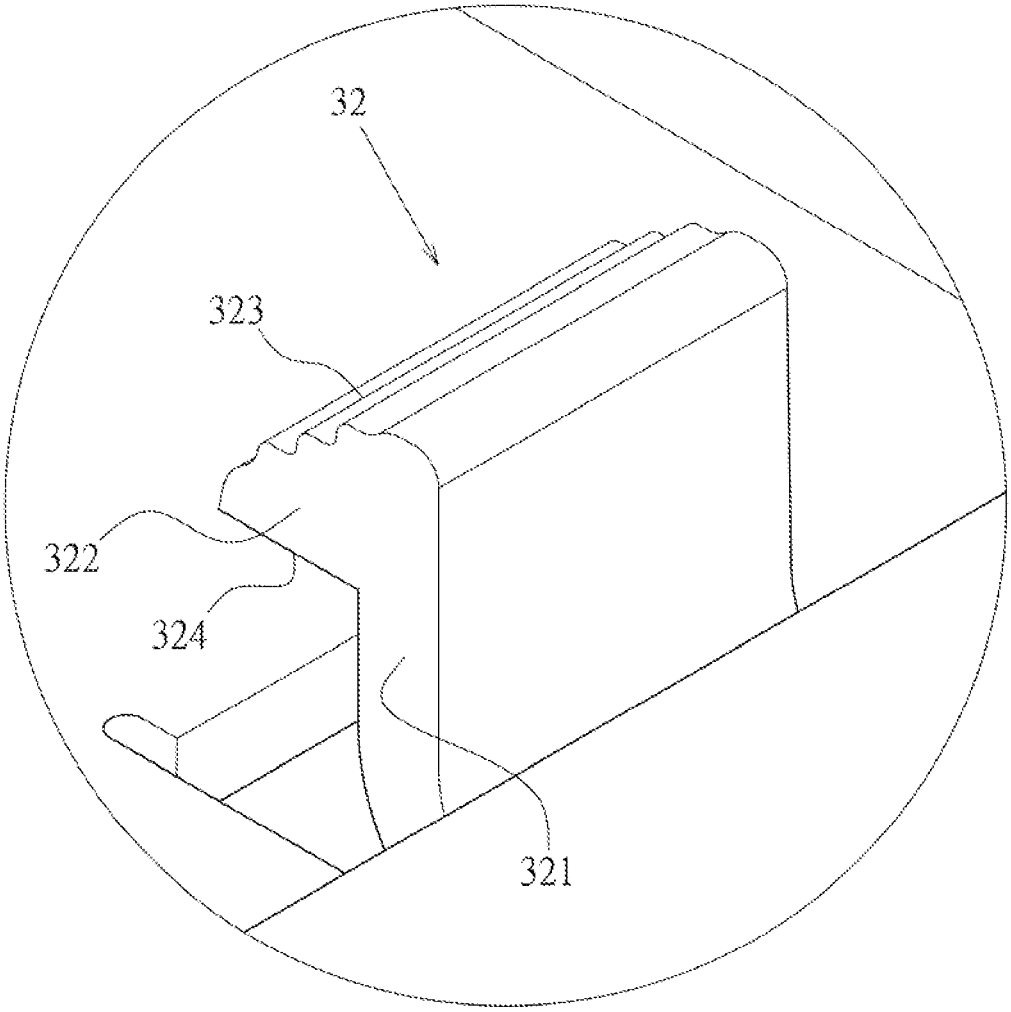
FIG. 12 is an enlarged view of Region 12 in FIG. 3.

Following the embodiment disclosed in previous paragraph, as shown in FIG. 2 and FIG. 3, the long plate section 23 of the tool placement track 20 includes a first nesting part 261 and a second nesting part 262, and the first nesting part 261 and the second nesting part 262 are spaced apart along the X axis. The placement area 11 includes a first convex pin 131 and a second convex pin 132. The first convex pin 131 and the second convex pin 132 are spaced apart along the X axis, and the locations of the first convex pin 131 and the second convex pin 132 are exactly aligned with the first nesting part 261 and the second nesting part 262, as shown in FIG. 11, the X-axis length of the first nesting part 261 is larger than the X-axis length of the first convex pin 131, so that the first nesting part 261 has an X-axis displaceable travel W1 in relation to the first convex pin 131. In this figure, the first nesting part 261 further defines a limiting end wall 263. When the end face of the first end 21 of the tool placement track 20 abuts on the end-type abutment wall 311, the limiting end wall 263 abuts on the corresponding side of the first convex pin 131 at the same time. In this case, the first nesting part 261 is set as an elongated hole, so that the first end 21 of the tool placement track 20 is inserted in the end-type limiting part 31 at a tilt angle, and then the long plate section 23 can be pressed smoothly.

Alternatively, the convex pin and the nesting part can be set in nesting relationship with taper fit (i.e. push-pull angle) (note: the figures of this case are omitted), in terms of the coordination configuration disclosed in this case, the nesting part is not limited to an elongated hole or a shape adapted to the convex pin, the long plate section 23 can be pressed smoothly.

Figure 14:
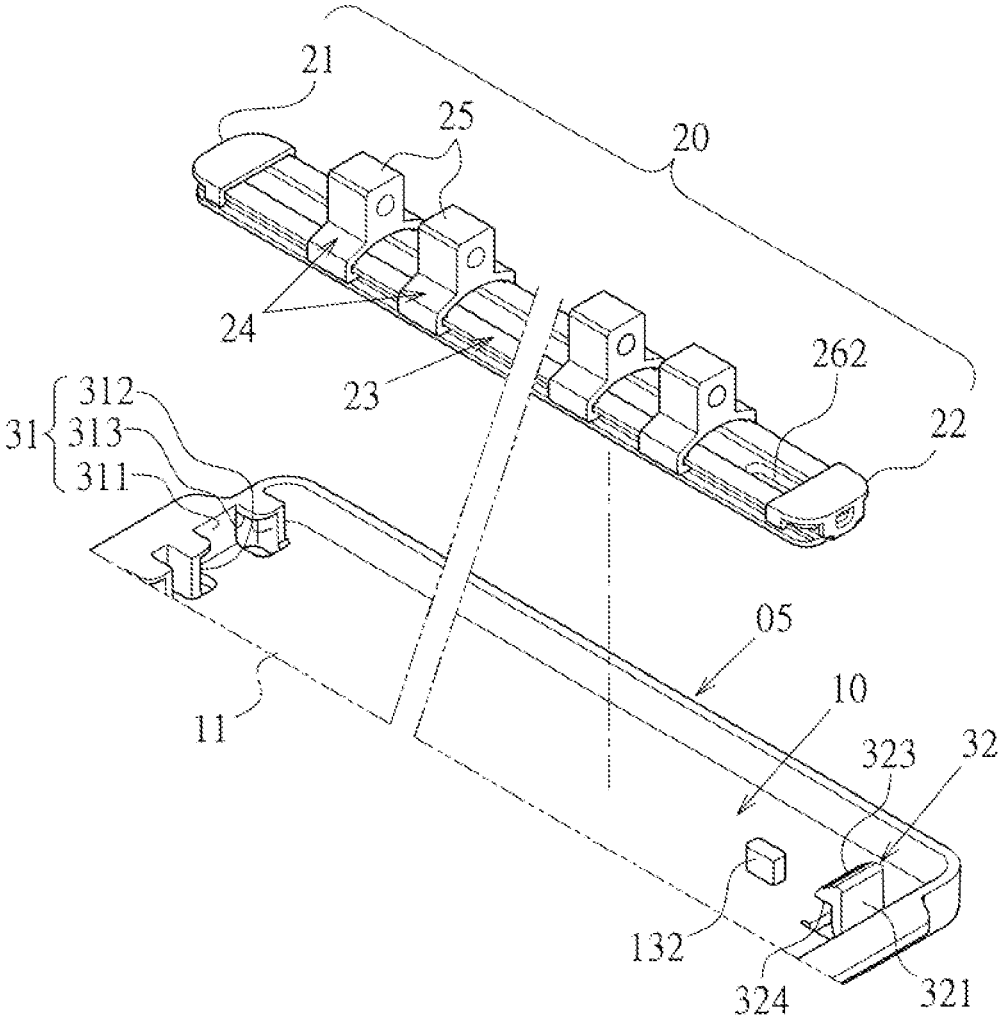
FIG. 14 is the embodiment of the convex pin and nesting part of the present invention in single unit fitting configuration.

FIG. 14 shows an implementation pattern only provided with the second convex pin 132 and the second nesting part 262. The configuration of this case is enough to increase the limiting strength of at least one axis of X and Y axes of the second end 22 of tool placement track 20.

Figure 6:
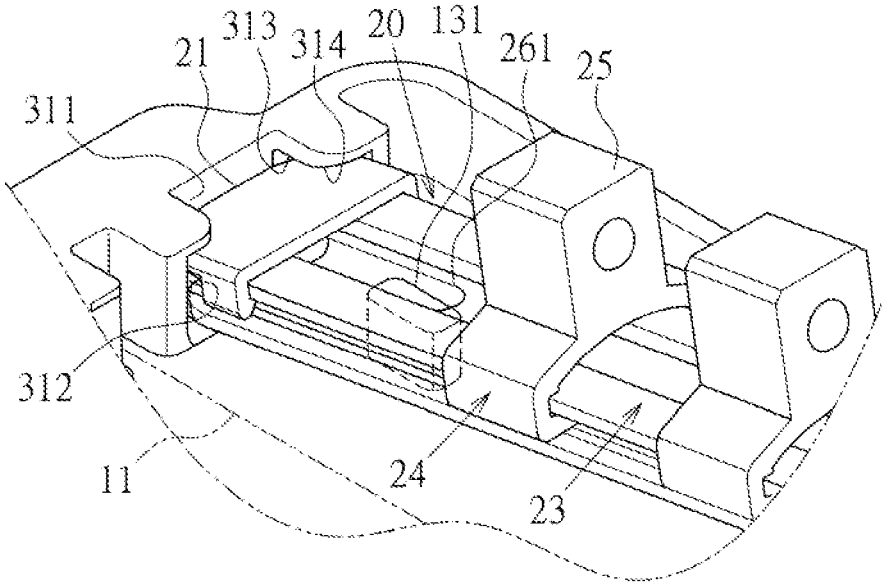
FIG. 6 is a stereogram II in combination action of the tool placement track of the present invention.
Figure 7:
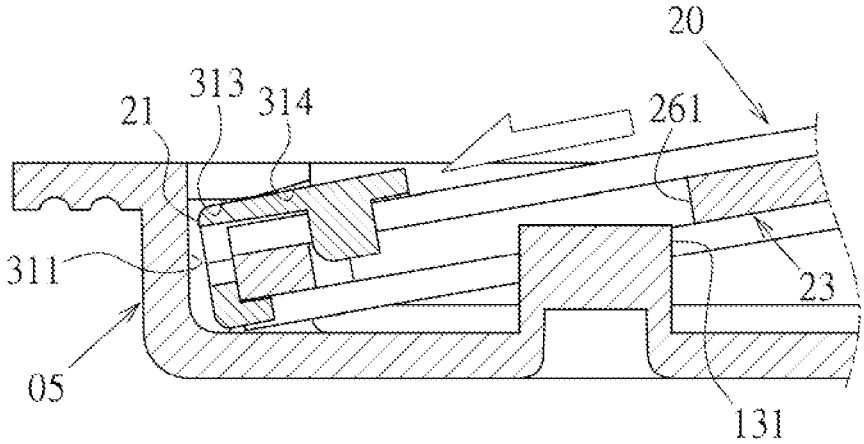
FIG. 7 is a longitudinal section view corresponding to FIG. 6.
Figure 8:
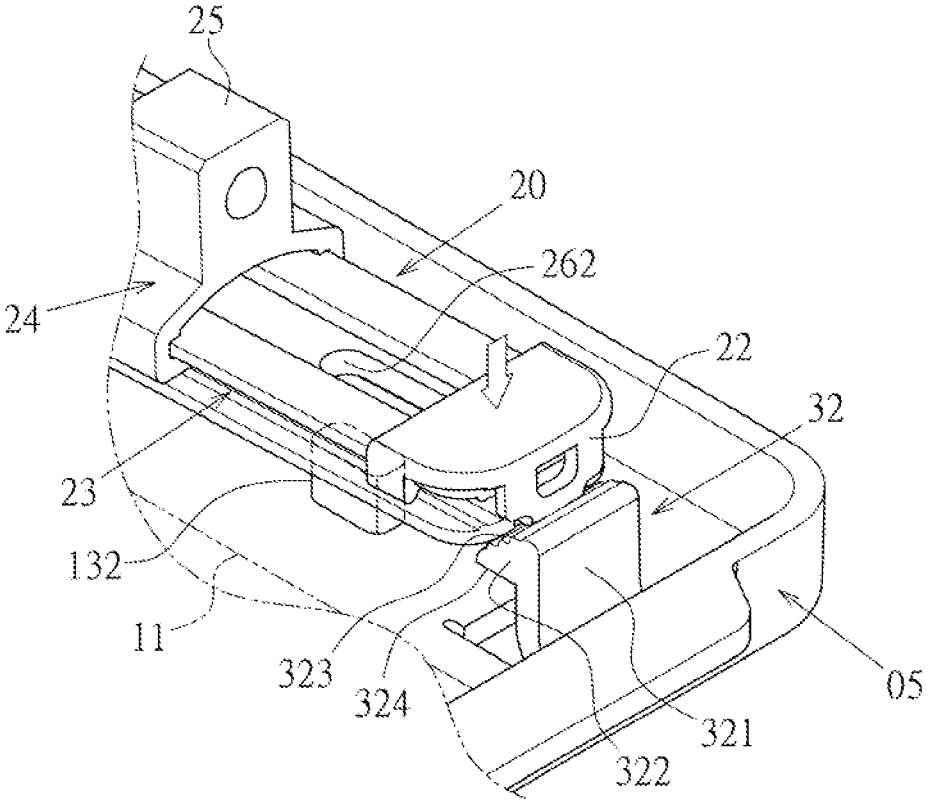
FIG. 8 is a stereogram III in combination action of the tool placement track of the present invention.
Figure 9:
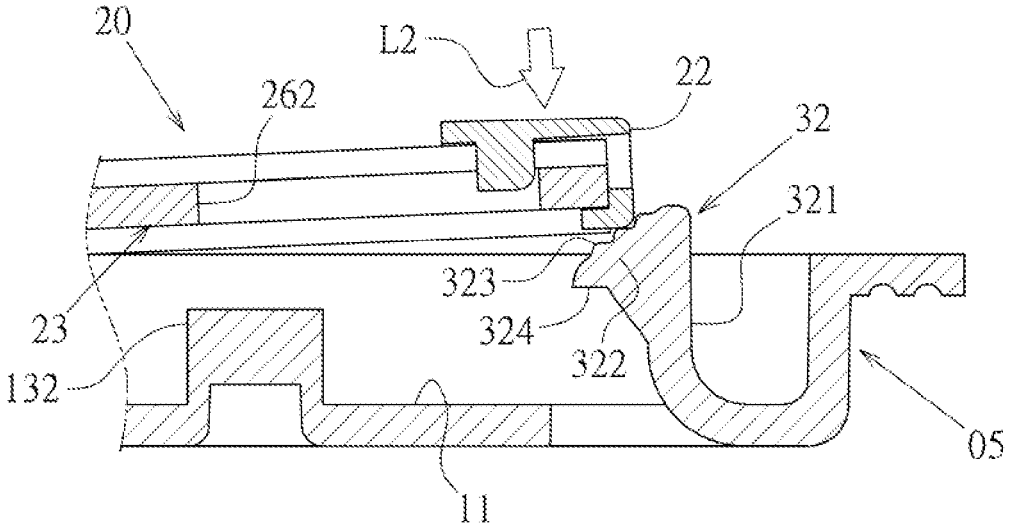
FIG. 9 is a longitudinal section view corresponding to FIG. 8.
Figure 10:
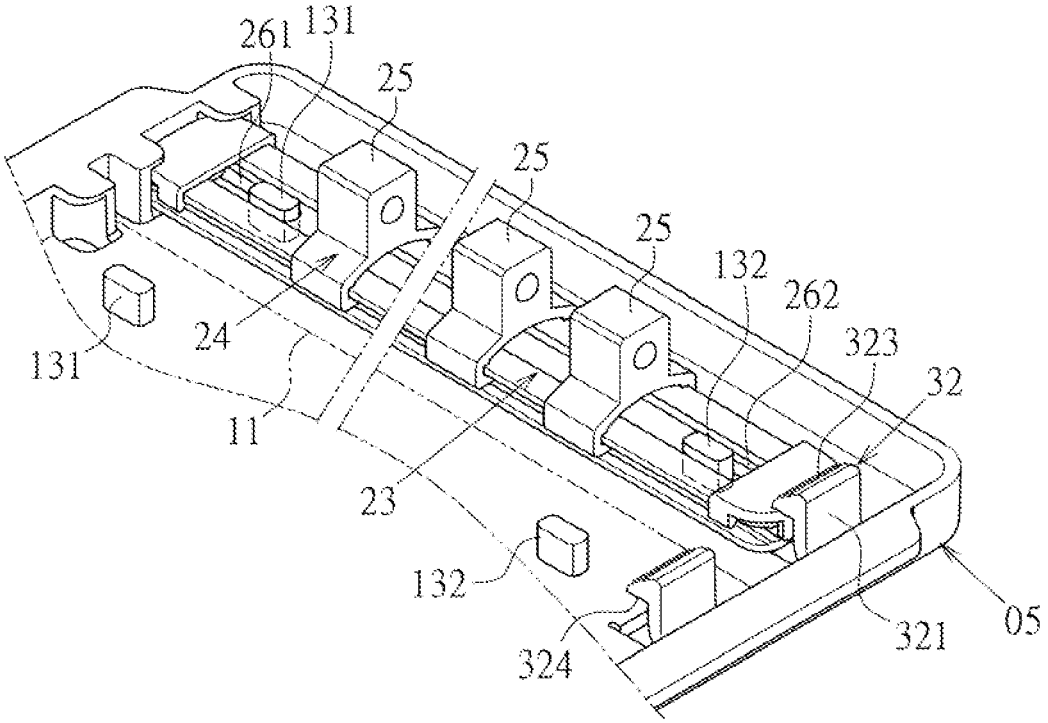
FIG. 10 is a stereogram after the combination action of the tool placement track of the present invention.

Based on the above structural configuration and technical characteristic, in terms of said preferred embodiment pattern of the tool placement device disclosed in the present invention in practical application, as shown in FIG. 4 and FIG. 5, to assemble the tool placement track 20 in the placement area 11, the first end 21 of the tool placement track 20 is displaced towards the end-type limiting part 31 at a tilt angle (see Arrow L1 in FIG. 5), and then as shown in FIG. 6 and FIG. 7, the end face of the first end 21 of tool placement track 20 is inserted to abut on the end-type abutment wall 311, and then as shown in FIG. 8 and FIG. 9, the second end 22 of the tool placement track 20 is pressed down (see Arrow L2 in FIG. 9) to go over the hook-shaped portion 322 of the elastic hook fastener 32, so as to form the combination positioning state disclosed in FIG. 10 and FIG. 11, meaning the end-type abutment wall 311 of end-type limiting part 31 abuts on the end face of the first end 21 of tool placement track 20, two lateral limiting walls 312 abut on two sides of the first end 21 of tool placement track 20, and the pressing edge 313 is pressed against the top surface of the first end 21 of tool placement track 20, so as to achieve the X, Y and Z axes limiting function. The second end 22 of the tool placement track 20 is pressed by the pressing face 324 of elastic hook fastener 32, so as to form the Z-axis limiting function, and the elastic arm 321 corresponds to the second end 22 of the tool placement track 20 along X axis, forming the X-axis limiting function. Thus it can be seen, the tool placement track 20 of the present invention is quite firm after assembly, it is impossible to shift towards any axis, so there is no probability of loosening. The operational safety is enhanced greatly. In the implementation pattern of said nesting part and convex pin, the limiting function of the long plate section 23 of tool placement track 20 on X and Y axes can be enhanced, so as to effectively prevent the tool placement track 20 from dropping off the placement area 11.

I claim:

1. A three-axis limiting tool placement device comprising:

a basic face defining an X axis and Y axis in a horizontal plane, said basic face having at least one placement area;

at least one tool placement track removably assembled in the at least one placement area, said at least one tool placement track being elongated along the X axis so as to form a first end and a second end and an elongated plate section between the first end and the second end, the elongated plate section having a plurality of tool sockets, the plurality of tool sockets having a cylinder protruding therefrom so as to define a Z axis; and a three-axis limiting structure formed in the at least one placement area of said basic face, said three-axis limiting structure comprising:

a limiting part formed at one end of the X-axis corresponding to a position of the first end of said at least one tool placement track, said limiting part having an abutment wall and a pair of lateral limiting walls and at least one pressing edge, said abutment wall abutting an end face of the first end of said at least one tool placement track so as to define an X-axis limiting function, the pair of lateral walls abutting respectively a pair of sides of the first end of the at least one tool placement track so as to define a Y-axis limiting function, the at least one pressing edge pressing against a top surface of the first end of said at least one tool placement track so as to define a Z-axis limiting function;

an elastic hook fastener formed at end of the X-axis of said at least one placement area in a position corresponding to the second end of said at least one tool placement track, said elastic hook fastener having an elastic arm extending toward the Z-axis from said at least one placement area and having a hook-shaped portion formed at a protruding end of the elastic arm, the hook-shaped portion having a dial control portion and a pressing face, the pressing face pressing against the second end of said at least one tool placement track, the elastic arm corresponding to the second end of said at least one tool placement track along the X-axis.

2. The three-axis limiting tool placement device of claim 1, wherein said basic face is formed on a tray structure.

3. The three-axis limiting tool placement device of claim 1, wherein said basic face is formed on a surface of a tool storage container, the tool storage container selected from the group consisting of a toolbox, a tool rack and a tool chest.

4. The three-axis limiting tool placement device of claim 1, wherein the at least one pressing edge is formed with an oblique guide face.

5. A three-axis limiting tool placement device comprising:

a basic face defining an X-axis and a Y-axis in a horizontal plane, said basic face having at least one placement area and at least one tool placement track removably assembled in the at least one placement area, the at least one tool placement track being elongated along the X-axis so as to define a first end and a second end and an elongated plate section between the first end and the second end, the elongated plate section having a plurality of tool sockets in which a cylinder protrudes therefrom, Z-axis being defined along a direction that the cylinder protrudes from the plurality of sockets;

at least one nesting part formed on the elongated plate section and positioned along the Z-axis; and a three-axis limiting structure formed in the at least one placement area of said basic face, said three-axis limiting structure comprising:

at least one convex pin protruding from said basic face along the Z-axis, said at least one convex pin being exactly aligned with said at least one nesting part;

a limiting part formed at one end of said at least one placement area in a position corresponding to the first end of adjacent at least one tool placement track, said limiting part having an abutment wall and a pair of lateral limiting walls and at least one pressing edge, the abutment wall abutting an end face of the first end of said at least one tool, placement track, the pair of lateral limiting walls abutting a pair of sides at the first end of said at least one tool placement track, the at least one pressing edge pressing against a top surface of the first end of said at least one tool placement track; and an elastic hook fastener formed at one end of the X-axis of the at least one placement area in a position corresponding to the second end of said at least one tool placement track, said elastic hook fastener having an elastic arm extending toward the Z-axis from said at least one placement area and having a hook-shaped portion formed at an end of the elastic arm, the hook-shaped portion having a dial control portion and a pressing face, the pressing face pressing against the second end of said at least one tool placement track, the elastic arm corresponding to the second end of said at least one tool placement track along the X-axis.

6. The three-axis limiting tool placement device of claim 5, wherein said basic face is formed on a tray structure.

7. The three-axis limiting tool placement device of claim 5, wherein said basic face is formed on a surface of a tool storage container, the tool storage container selected from the group consisting of a tool box, a tool rack and a tool chest.

8. The tree-axis limiting tool placement device of claim 5, wherein the elongated plate section of said at least one tool placement track has a first nesting part and a second nesting part; the first nesting part and the second nesting part being spaced apart along the X-axis, the at least one convex pin comprising a first convex pin and a second convex pin in said at least one placement area, the first convex pin and the second convex pin being spaced apart along the X-axis, the first convex pin and the second convex pin being exactly aligned with the first nesting part and the second nesting part, a length of the first nesting part along the X-axis being greater than a length of the second nesting part along the X-axis, the first nesting part having a displaceable travel along the X-axis in relation to the first convex pin.

9. The tree-axis limiting tool placement device of claim 5, wherein the at least one pressing edge is formed with an oblique guide face.

10. The tree-axis limiting tool placement device of claim 5, wherein the at least one convex pins and the at least one nesting area are in a nesting relationship with a tapered fit.

* * * * *